US005735721A

United States Patent [19]

Choi

[11] Patent Number: 5,735,721

[45] Date of Patent: Apr. 7, 1998

[54] METHOD FOR FABRICATING A FIELD EMISSION DISPLAY

[75] Inventor: Jun-hee Choi, Seoul, Rep. of Korea

[73] Assignee: Samsung Display Devices Co., Ltd., Kyungki-do, Rep. of Korea

[21] Appl. No.: 479,040

[22] Filed: Jun. 7, 1995

[30] Foreign Application Priority Data

Jan. 28, 1995 [KR] Rep. of Korea ..... 1995-1774

[51] Int. Cl.[6] ..... H01J 9/02

[52] U.S. Cl. ..... 445/24; 445/59

[58] Field of Search ..... 445/24, 59; 313/309, 313/336

[56] References Cited

U.S. PATENT DOCUMENTS 3,755,704 8/1973 Spindt et al. ..... 313/309

4,857,161 8/1989 Borel et al. ..... 313/309 X 4,857,799 8/1989 Spindt et al. ..... 313/309 X 4,933,303 6/1990 Mo ..... 437/190

5,244,428 9/1993 Welsch et al. ..... 445/59 X

*Primary Examiner*—Kenneth J. Ramsey

*Attorney, Agent, or Firm*—Foley & Lardner

[57] ABSTRACT

A method for fabricating a field emission display device, in which a photoresist is formed on a gate electrode layer to form a release layer, a metal mask is formed thereon, and holes are etched to form micro-tips, thus simplifying the fabrication process thereof. Also, the size and shape of the micro-tips are easily adjustable. Further, since the photoresist can be easily soluble in a solvent, the problem of contamination during the etching process is resolved, thereby improving the reliability of a manufactured field emission display device.

9 Claims, 5 Drawing Sheets

METHOD FOR FABRICATING A FIELD EMISSION DISPLAY

BACKGROUND OF THE INVENTION

1. Field of the Invention

The present invention relates to a method for fabricating a field emission display, and more particularly, to a method for fabricating a field emission display which can be adopted as a source for a flat panel display, an ultra-harmonic amplifier sensor or an electron-beam-applied instrument.

2. Description of Related Art

Currently, personalized and space-saving displays are in demand for interfacing between people and computers and various computerized mechanical instruments. Accordingly in response to such demand, research into various plane screen or flat panel displays to be adopted for wall-mounted (tapestry) televisions or for high definition television is vigorously under way. The goal of this research is an image display device which can replace the cathode ray tube for existing display devices, particularly, conventional television receivers which are cumbersome to handle due to their relatively high electricity consumption and bulky size.

In general, flat panel displays include a plasma display panel, a liquid crystal display, and a field emission display. Among these, the liquid crystal display (LCD) of the non-active luminescent type, which can be driven using a small amount of electricity, is being aggressively researched and developed in Japan, the U.S.A., and European countries. The LCD, however, involves problems such as a restricted viewing angle and low luminance. Accordingly, as a flat panel display, an active luminescent type field emission display has been newly developed.

The field emission display typically includes a field electron emitting device and a plate having a fluorescent body for illumination from received electrons, which are provided in a closed high vacuum sealed space to facilitate electron emission. Also, if a predetermined level of voltage is applied to the gate and cathode of the field electron emitting device, electrons are emitted from an array of micro-tips by way of a field emission method. The thus-emitted electrons are accelerated to an anode plate having a fluorescent body for illumination. Also, the field electron emitting device includes up to several hundred micro-tips on a pixel which is the basic unit for image display. The field electron emitting device can solve a drawback in pixel operation, that is, a pixel is not activated if a transistor does not operate, as in the case of a thin-film transistor LCD. Also, the field electron emitting device, which exhibits a high luminance and low electricity consumption, can extend the angle of the view-field by the illumination principle as a result of electrons impinging on a fluorescent body. Moreover, due to recently advanced semiconductor fabricating techniques, a variety of methods for fabricating micro-tips using these techniques have been proposed. Thus, the aforementioned field electron emitting device is expected to be in the forefront as a display device for the next generation.

FIG. 1 is a vertical cross-sectional view of the above-described conventional field emission display. The structure thereof will now be described with reference to FIG. 1.

A cathode layer 2 is formed on a lower glass substrate 1 in a predetermined pattern. An insulation layer 3 having a predetermined pattern of apertures formed thereon is deposited on cathode layer 2. Then, an array of cone-shaped field emitting micro-tips 6 with extremely small diameters and electrically connected with the cathode layer 2 are formed on the surface of cathode layer 2 in each aperture formed on insulation layer 3. A striped gate electrode 4 having a micro-hole 4*a* corresponding to the aperture of the insulation layer 3 is subsequently deposited.

In the field emission display having the aforementioned structure, if predetermined potentials are applied to the cathode layer 2 and gate electrode layer 4, electrons are emitted from the field emitting micro-tips 6 formed on the cathode layer 2 by a potential field effect. For example, if a voltage of up to several hundred volts is applied with respect to the cathode layer 2, an electrical field of about $10^6$ V/cm to $10^7$ V/cm is formed at the peak of the cone-shaped micro-tips 6. This induces a current of about $10^{-1}$ μA to 10 μA, thereby obtaining a total electron emission of about several hundred milliamperes.

The above-described conventional field emission display is fabricated through several stages of fabrication as schematically shown in FIGS. 2 to 4, in which FIG. 2 is a vertical cross-sectional view of the field emission display during a process of forming a micro-hole in a gate electrode layer, FIG. 3 is a vertical cross-sectional view of the field emission display during a grazing angle deposition process, and FIG. 4 is a vertical cross-sectional view of the field emission display during a micro-tip deposition process.

The conventional method for fabricating the conventional field emission display will now be described with reference to FIGS. 2 to 4.

First, as shown in FIG. 2, a cathode layer 2 is formed on a glass substrate 1 in a stripe pattern. An insulation layer 3 and a gate electrode layer 4 having a desired, predetermined pattern are sequentially deposited.

As shown in FIG. 3, a release layer 5 is deposited at a grazing angle $\phi$. Next, as shown in FIG. 4, the same material as that of the cathode layer 2 is deposited to form the micro-tips 6.

Then, the release layer 5 is etched to finally complete the device as shown in FIG. 1. It is noted that reference numeral 6' denotes an unnecessary layer of material produced during deposition of the micro-tips 6 and which is removed at the same time as release layer 5.

Throughout the fabrication process of the field emission display, it is crucial to form an array of micro-tips of several nanometers in diameter. In the above described process, the release layer 5 is typically formed by the deposition of a metal, before forming the micro-tip 6, but after the formation of the gate layer 4 and micro-hole 4*a*. This process is necessary in order to cleanly remove unnecessary deposited tip material 6'. Also, this process adopts a grazing angle deposition method as shown in FIG. 3.

The grazing angle deposition method requires specific equipment to form an angle between the depositing direction of the deposition material and substrate of about 15° to prevent the release layer material from being introduced into the interior of the micro-tip hole. This is a considerably complex task in practice. Thus, operational performance is lowered, and manufacturing cost is increased, thereby decreasing overall productivity. Also, since the thickness of the release layer 5 is fixed, a change in the geometrical structure such as the height of the micro-tip cannot be tolerated, thereby lowering the uniformity of the emitted electrical field. Further, since an electrochemical etching process is adopted in removing the metal release layer 5, the residual metal material contaminates the field emission display device, thereby causing current leakage in the device and thus lowering its reliability.

SUMMARY OF THE INVENTION

To solve the above-described drawbacks of the prior art, it is an object of the present invention to provide a method for fabricating a field emission display which can simplify the fabrication process by adopting a photoresist deposition and removal method instead of the release layer of the conventional technique.

To accomplish the above object, the method for fabricating the field emission display according to the present invention comprises the steps of: (a) forming a striped cathode layer on a substrate; (b) forming an insulation layer on the cathode layer; (c) depositing a gate electrode layer on the insulation layer and etching the same to form gate electrodes in a stripe pattern that is cross-wise, preferably perpendicular, to the stripe pattern of the cathode layer; (d) forming a photoresist layer on the gate electrode layer; (e) etching the photoresist layer by a photoresist process using a metal mask to form a hole in the photoresist layer of a predetermined size; (f) etching the gate layer using the unetched photoresist as a mask for use as a release layer; (g) etching the insulation layer to form a hole therein aligned with the hole in the photoresist layer; (h) forming a cone-shaped field emitting micro-tip on the bottom of the hole formed in the insulating layer; and (i) removing the photoresist layer.

In the method for fabricating the field emission display according to the present invention, the photoresist layer etching step preferably includes the steps of exposing the photoresist layer to light using a metal mask and selectively etching the photoresist layer by either reactive ion etching (RIE) or a wet etching process.

Also, before forming the cone-shaped field emitting micro-tips within the holes, it is preferable to further include removing the photoresist layer remaining in the holes by means of an oxygen plasma device while leaving the photoresist layer on the gate layer, and then pre-baking the photoresist.

Also, the cathode layer is preferably formed at about a 1,500 to 2,000 Å thickness using chromium (Cr) or indium tin oxide (ITO). The insulation layer is preferably formed of 1.0 μm of silicon dioxide ($SiO_2$), and the gate layer is preferably formed at 1,500 to 2,000 Å thickness using molybdenum (Mo) or chromium (Cr).

The above process is used to form a field emission display device. In accordance with the invention there is further provided a method for fabricating a field emission display comprising the steps of: forming a cathode layer on a substrate; forming an insulation layer on the substrate and the cathode layer; forming a gate electrode on the insulation layer; forming a photoresist layer on the insulation layer and the gate electrode; selectively removing a portion of the photoresist to form a plurality of holes in the photoresist layer; etching the gate electrode using the etched photoresist layer as a mask; etching said insulation layer to form a plurality of holes aligned with the holes of the photoresist layer; forming a cone-shaped field emitting micro-tip electrically connected to the cathode layer in each of the holes formed through the photoresist layer and the insulating layer; and removing the remaining portion of the photoresist layer.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE PREFERRED EMBODIMENTS

Figure 13:
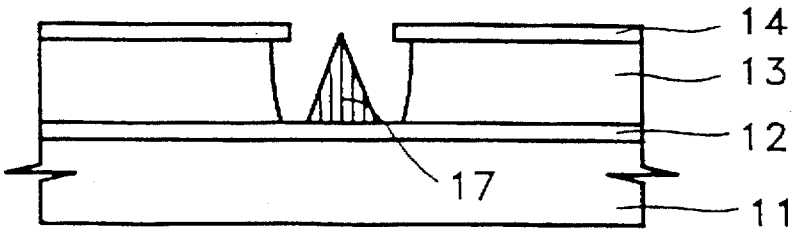
FIG. 13 is a vertical, cross-sectional view of a completed field emission display fabricated in accordance with the present invention.

Referring, to FIG. 13. the field emission display fabricated in accordance with the method of the present invention has the same structure as that fabricated in accordance with the conventional fabrication method. As shown in FIG. 13, the field emission display according to the present invention includes a glass substrate 11, a cathode layer 12 formed on the glass substrate 11, a plurality of micro-tips 17 formed on the cathode layer 12 in an array structure for emitting an electrical field, an insulation layer 13 formed to surround the micro-tips 17, and a gate electrode 14 formed on the insulation layer 13 so as to have micro-holes **14*a* which allow field emission from the upper micro-tips 17**.

Referring now to FIGS. 5 to 12, the method for fabricating the field emission display according to the present invention will be described.

Figure 1:
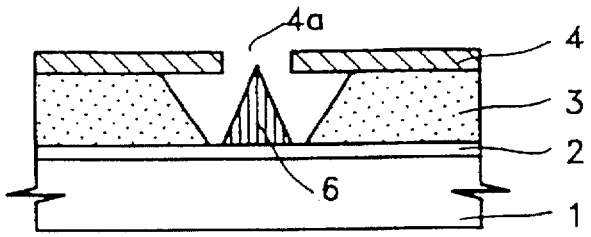
FIG. 1 is a vertical, cross-sectional view of a conventional field emission display device.
Figure 2:
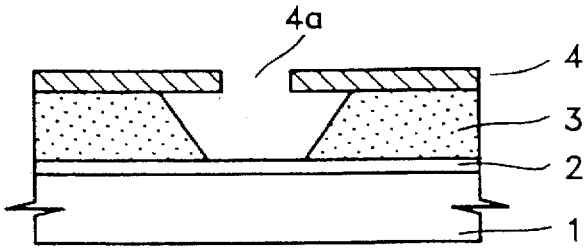
FIGS. 2 to 4 are vertical cross-sectional views of the conventional field emission display device during the conventional fabrication process.
Figure 3:
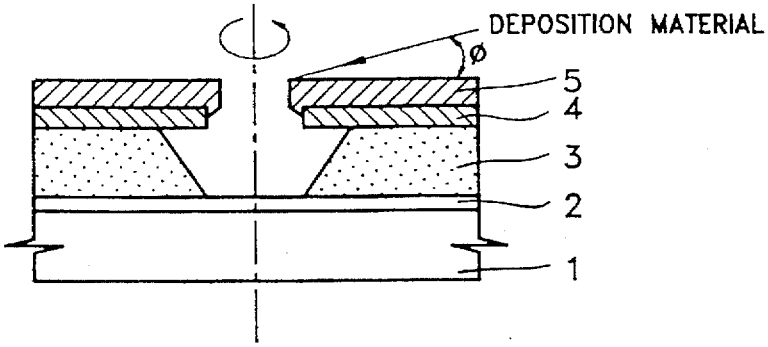
Figure 4:
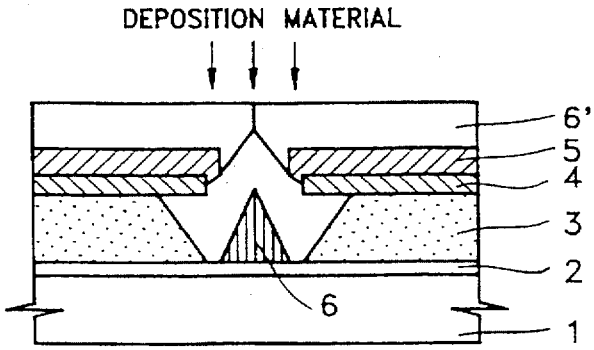
Figure 5:
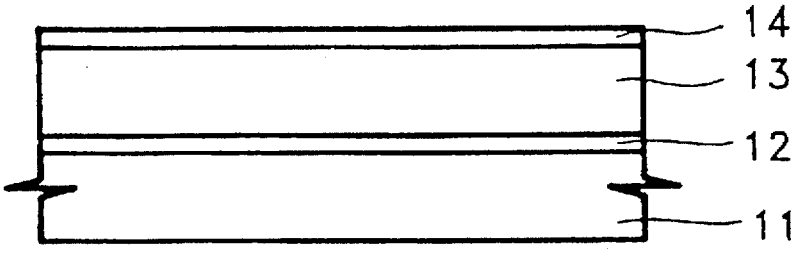
FIGS. 5 to 12 are vertical, cross-sectional views of a field emission display device showing the fabrication process of a field emission display according to the present invention.

Referring to FIG. 5, which shows a gate electrode layer forming process, a transparent chromium (Cr) or indium tin oxide (ITO) is deposited on glass substrate 11 at a thickness of between about 1,500 to 2,000 Å by an evaporation method and is then etched in a stripe pattern to form a cathode layer 12. Silicon dioxide $SiO_2$ at a thickness of about 1 μm is deposited on the cathode layer 12 using a chemical vapor deposition method to form an insulation layer 13. Also, molybdenum (Mo) or chromium (Cr) at a thickness of between about 1,500 to 2,000 Å in thickness is deposited on the insulation layer 13 and is then patterned to create a stripe pattern that is cross-wise, preferably perpendicular, to that of the cathode layer 12 to form a gate electrode layer 14.

Figure 6:
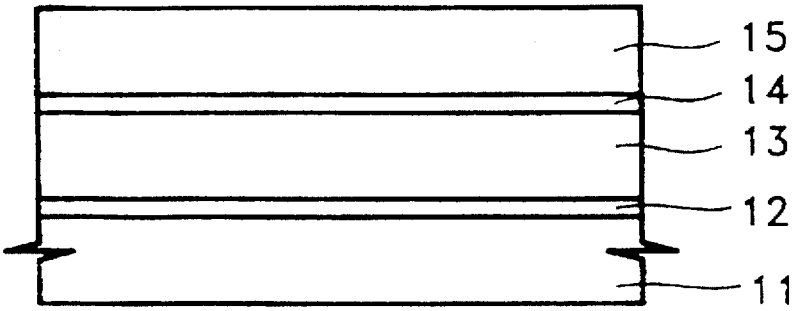
Figure 7:
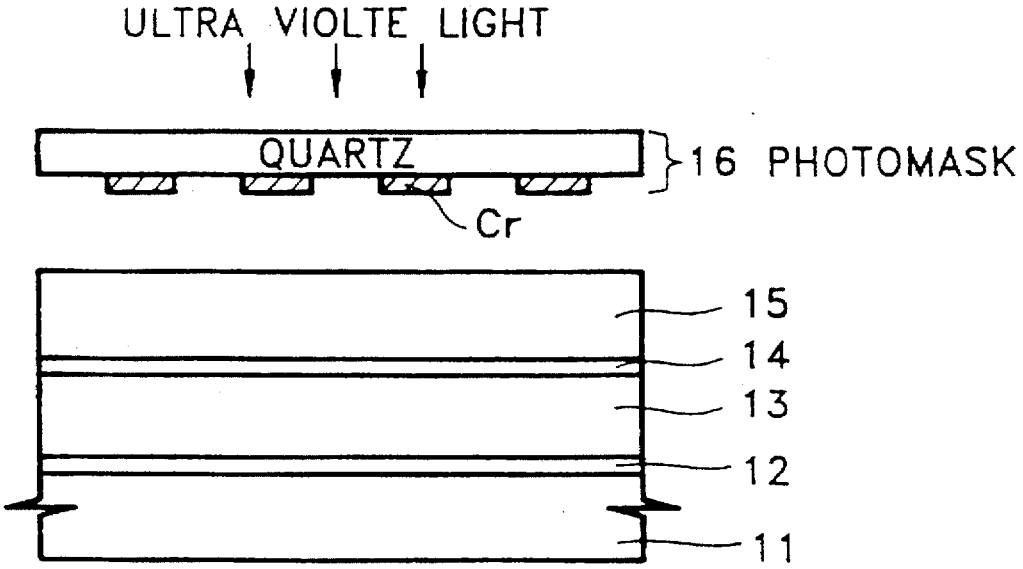
Figure 8:
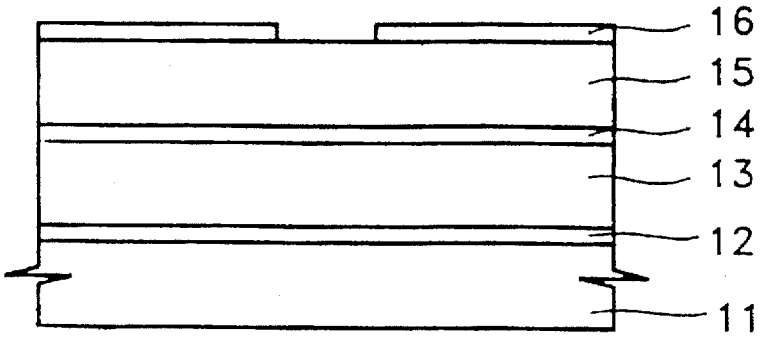
Figure 9:
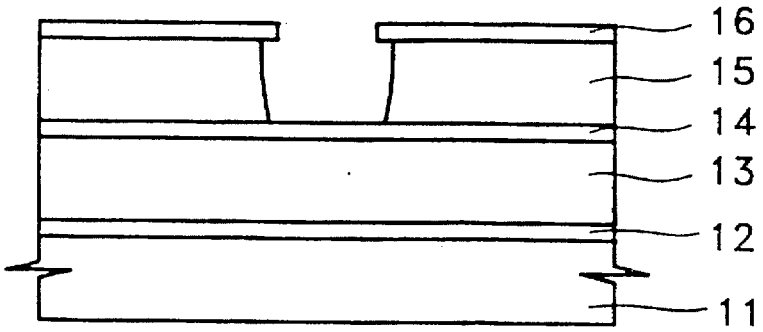

Next, as shown in FIG. 6, a positive photoresist (AZ-series) is coated on the gate electrode layer 14 to form a photoresist layer 15. Thereafter, by a general photoresist process using a metal mask 16 (shown in FIG. 7), the photoresist layer 15 is exposed to light and is etched, as shown in FIGS. 8 and 9, to remove selected portions of the photoresist layer 15. Processing is then carried out to form a micro-hole on the gate electrode layer 14 and insulating layer 13 in order to form a plurality of cone-shaped micro-tips 17 (FIGS. 12 and 13) for field emission from the cathode layer 12.

Figure 10:
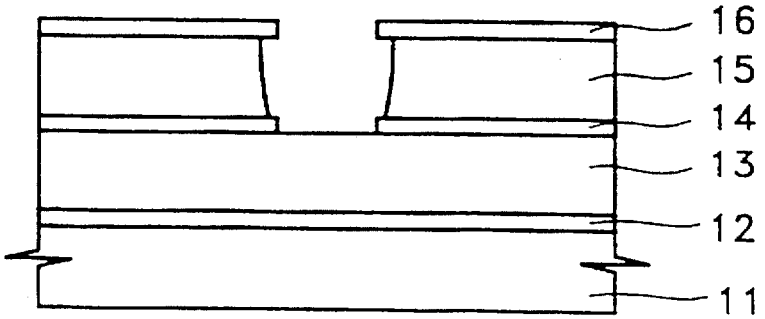
Figure 11:
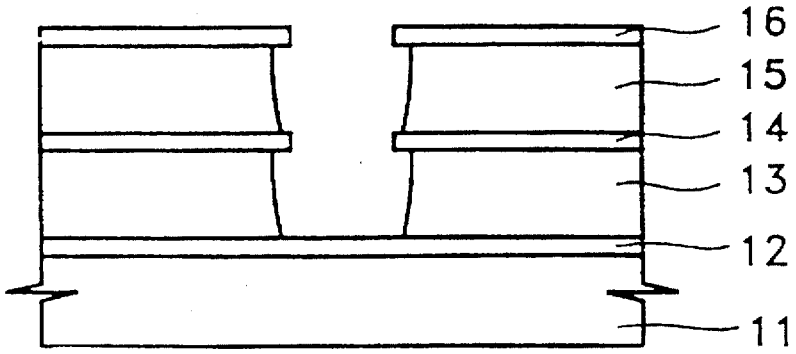

The insulating layer 13 and gate electrode layer 14 are selectively etched by an RIE or wet etching process, thereby completing the formation of the micro-holes, as shown in FIGS. 10 and 11.

The portion of the photoresist 15 left on the gate electrode layer 14 (i.e., the unetched portion of the etched photoresist layer) is used as a release layer, and then the photoresist remaining within the holes is removed with an oxygen plasma device. Then, the photoresist is pre-baked at about 150° C. for five to ten minutes, thereby reducing the diameter of the holes 14*a*.

Figure 12:
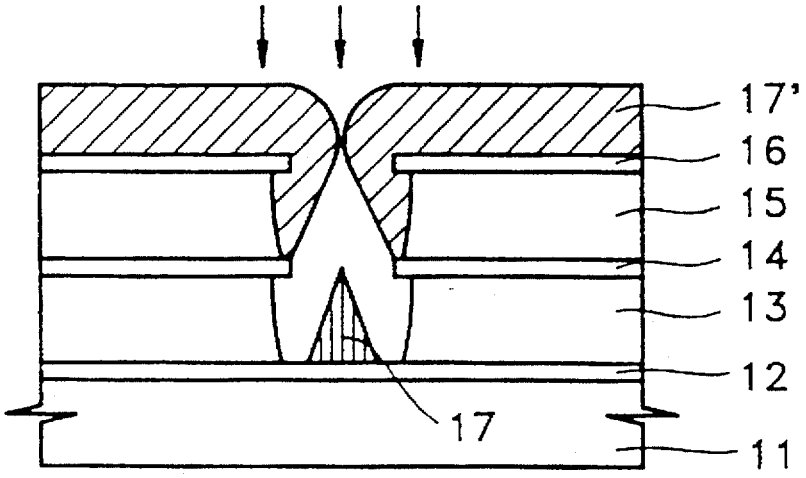

Next, as shown in FIG. 12, molybdenum, used as the tip deposition material, is vertically deposited into the holes, thereby forming cone-shaped micro-tips 17 for field emission and barrier layer 17'. Thereafter, as shown in FIG. 13, the release layer of the photoresist 15 and the barrier layer 17' of the tip deposition material are removed by a photoresist stripping method using a solvent such as acetone, and the complete micro-tip portion of the field emission display as shown FIG. 13 is produced.

Figure 14:
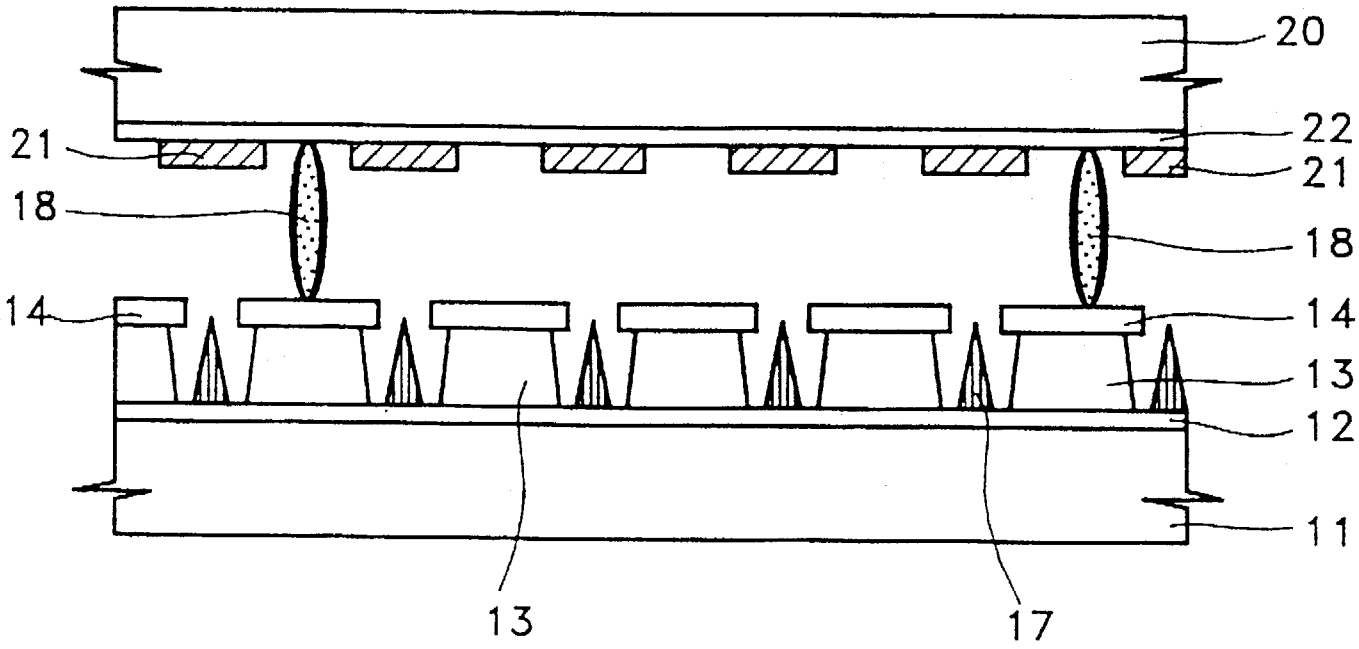
FIG. 14 is a schematic, cross-sectional view showing a display device using the field emission display according to the present invention.

The field emission display fabricated through the aforementioned steps has an upper glass substrate 20 disposed above the micro-tip structure and is vacuum-sealed by means of spacers 18, as shown in FIG. 14. A transparent transmission film 22 and a fluorescent layer 21 are deposited under the upper glass substrate 20. Also, micro-holes (not shown) to be connected to a vacuum diffusion pump (not shown) are formed under lower glass substrate 11, to form a closed high vacuum space.

In the above-described structure, with the cathode layer 12, a higher positive voltage than that of the gate electrode layer 14 is applied to the upper glass substrate 20, so that electrons emitted from the field emission display impinge via the high vacuum space on fluorescent layer 21 formed on upper glass substrate 20, causing illumination. At this time, a display signal is properly transmitted to the plurality of cathodes and gates, thereby displaying a desired image.

If a harmonic bias voltage is applied to the gate of the field emission display device, the device operates as an ultra-harmonic amplifier. If a separate control grid is attached to the field emission display device, the device can be applied to any electron-beam-applied system such as a sensor, scanning electron microscope (SEM), or electron-beam lithography tool.

As described above, according to the method for fabricating the field emission display of the present invention, a grazing angle deposition method by which a metal layer is used as a release layer is not adopted. Instead, photoresist is formed on a gate electrode layer to form the release layer, a metal mask is formed thereon, and holes are etched to form micro-tips. Thus, the fabrication process can be simplified. Also, according to the present invention, the size and shape of the micro-tips are easily adjustable. Further, since the photoresist is easily soluble in a solvent, the problem of contamination during the etching process is solved, thereby improving the reliability of the device.

What is claimed is:

1. A method for fabricating a field emission display comprising the steps of:

(a) forming a cathode layer having a striped pattern on a substrate;

(b) forming an insulation layer on said substrate;

(c) depositing a gate electrode layer on said insulation layer and etching said gate electrode layer to form a gate electrode having a stripe pattern perpendicular to the striped pattern of said cathode layer;

(d) forming a photoresist layer on said insulation layer;

(e) etching said photoresist layer using a metal mask to form a hole of a predetermined size therein;

(f) etching said gate layer using said photoresist as a mask for use as a release layer;

(g) etching said insulation layer to form a hole therein aligned with the hole of the photoresist layer;

(h) forming a cone-shaped field emitting micro-tip on a bottom of the hole formed in step (g); and (i) removing said photoresist layer.

2. A method for fabricating a field emission display as claimed in claim 1, wherein in said steps (f) and (g), said insulation layer and said gate layer are selectively etched by one of a wet and dry etching process.

3. A method for fabricating the field emission display as claimed in claim 2, wherein said dry etching process is a selective etching process using reactive ion etching (RIE).

4. A method for fabricating the field emission display as claimed in claim 1, further comprising, prior to the step (h), the steps of:

treating the substrate in an oxygen plasma device to remove the photoresist remaining within the holes of the photoresist layer and the insulation layer; and pre-baking the photoresist.

5. A method for fabricating the field emission display as claimed in claim 1, wherein the cathode layer is formed of one of chromium (Cr) and indium tin oxide (ITO) at a thickness of about 1,500 to 2,000 Å.

6. A method for fabricating the field emission display as claimed in claim 5, wherein the insulation layer is formed of silicon dioxide ($SiO_2$) at a thickness of approximately 1 μm.

7. A method for fabricating the field emission display as claimed in claim 6, wherein the gate layer is formed of molybdenum (Mo) and is between approximately 1,500 to 2,000 Å thick.

8. A method for fabricating the field emission display as claimed in claim 6, wherein the gate layer is formed of Chromium (Cr) and is between approximately 1,500 to 2,000 Å thick.

9. A method for fabricating a field emission display comprising the steps of:

forming a cathode layer on a substrate;

forming an insulation layer on said substrate and said cathode layer;

forming a gate electrode on said insulation layer;

forming a photoresist layer on said insulation layer and said gate electrode;

selectively removing a portion of said photoresist to form a plurality of holes in said photoresist layer;

etching said gate electrode using said etched photoresist layer as a mask;

etching said insulation layer to form a plurality of holes aligned with the holes of said photoresist layer;

forming a field emitting micro-tip electrically connected to the cathode layer in each of the holes formed through said photoresist layer and said insulating layer; and removing the remaining portion of said photoresist layer.

* * * * *